United States Patent [19]

Jacobs

[11] 4,254,948

[45] Mar. 10, 1981

[54] MECHANIZED CRUTCH

[76] Inventor: Eugene A. Jacobs, 8119 Oakleigh Rd., Baltimore, Md. 21234

[21] Appl. No.: 1,211

[22] Filed: Jan. 5, 1979

[51] Int. Cl.[3] ..... A61H 3/04

[52] U.S. Cl. ..... 272/70.3; 135/68; 280/87.2 R; 297/5

[58] Field of Search ..... 135/65, 67, 68, 85; 297/5; 280/87.02; 272/70, 70.3, 70.4

[56] References Cited

U.S. PATENT DOCUMENTS

| | | | |
|---|---|---|---|
| 2,077,569 | 4/1937 | Kish | 272/70.4 |
| 2,244,869 | 6/1941 | Everest et al. | 135/68 |
| 2,469,359 | 5/1949 | Ames | 297/5 X |
| 2,778,370 | 1/1957 | Chamblee | 135/68 |
| 3,397,883 | 8/1968 | Kiehn | 297/5 X |
| 3,872,945 | 3/1975 | Hickman et al. | 297/5 X |

FOREIGN PATENT DOCUMENTS

| | | | |
|---|---|---|---|
| 401711 | 9/1924 | Fed. Rep. of Germany | 135/85 |

*Primary Examiner*—J. Karl Bell

*Attorney, Agent, or Firm*—Cushman, Darby & Cushman

[57] ABSTRACT

A mechanized crutch having vertically adjustable leg rest and body bracket, a wide tread wheel, a drive belt, gearing and a drive wheel are mounted on an elongated leg means. The leg rest and body bracket provide body support. The drive belt, gearing and drive wheel are arranged on the elongated leg means to transmit locomotive power from the drive wheel to the wide tread wheel mounted on the bottom of the elongated leg means. The drive wheel, which may be manual or battery powered, is located within reach of the user's hand on the side of his injured leg. Stabilization is provided by front and rear outrigger tubing having small wheels which roll on the walking surface.

14 Claims, 2 Drawing Figures

MECHANIZED CRUTCH

BACKGROUND OF THE INVENTION

The invention relates to a mechanized device for aiding a person in walking.

A very common means of support and locomotion for persons having an injured leg is the crutch. Traditionally a crutch comprises an elongated, generally T-shaped structure which provides the user with a body support and a hand support, the body support being in the form of a short piece which fits in the armpit of the user.

This crutch arrangement has several disadvantages. It supports the body in a sensitive area adjacent to the armpit, requires the exertion of a substantial force on the hand supports during locomotion and also requires the user to hold his injured leg off the ground. Depending on the nature of the leg injury, and the strength and agility of the user, such a crutch may be quite uncomfortable or may even be a totally impractical means of support and locomotion.

Some attempts to resolve these problems have been attempted. A crutch having a knee support which supports the injured leg off the ground is shown in U.S. Pat. No. 3,213,870 (Kiehn, 1965). A crutch having a torso support is shown in U.S. Pat. No. 2,378,486 (Jones, 1944).

However, all of the prior devices discussed above require the exertion of considerable muscle power through hand supports in order to simultaneously support the body and provide forward hopping on the uninjured leg. There is therefore a need for a crutch which both supports the user in an upright position with the uninjured leg resting on the ground and substantially reduces the muscle power required for locomotion. Such a crutch should also support the body in a comfortable manner.

BRIEF SUMMARY OF THE INVENTION

The recited limitations and disadvantages of prior crutches are overcome by providing a mechanized crutch which comfortably supports the body, including the injured leg, while at the same time providing a means for locomotion (closely assimilated to actual walking) which utilizes a main wheel at the base of the crutch, suitably driven by an arm or battery power pack controlled drive wheel, a drive belt and a gear train.

In its preferred embodiment a vertically and horizontally adjustable leg rest for supporting the injured leg is attached to the vertical main frame of the crutch. A vertically adjustable curved body support bracket may be fixed at the top of the main frame according to the body height of the user. A multiple point bottom support which has a stabilizing effect in the plane perpendicular to the line of travel may be provided by an additional two small wheels respectively fixed in front and in back of the main wheel by front and rear outrigger tubing. Accordingly, the mechanized crutch of the present invention provides the advantages of comfort, leg support, stability and ease of locomotion not found in prior crutches. The choice of manual or power drive makes the device adaptable to a wide range of single leg injuries and to persons of varying degrees of strength and agility.

DESCRIPTION OF THE PREFERRED EMBODIMENTS

Figure 1:
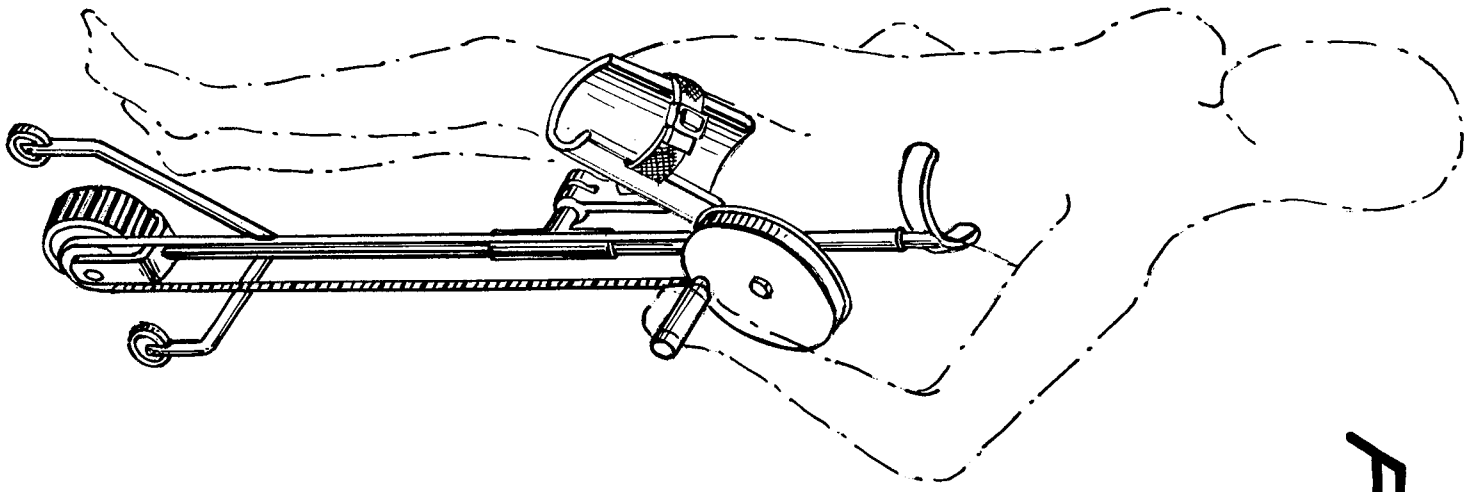
FIG. 1 is a perspective view of a manually operated mechanized crutch in accordance with the present invention.

The preferred embodiment of the mechanized crutch in accordance with this invention is shown in perspective in FIG. 1 with a person in position to utilize the crutch shown in outline form. The crutch, generally designated by the numeral 10, has an elongated leg 12 suitably composed of a main frame tube 14 having vertically spaced holes, a C-shaped bracket 16 attached to its lower end suitable for mounting a wheel 18 which provides the main bottom support in locomotion of the mechanized crutch 10 and its user, and front and rear outrigger stabilizers 20 and 22 having small wheels 24 and 26. Also provided is a leg brace 30 suitably composed of stainless steel or moled plastic and having a quick release strapping 32 for securing the injured leg in the leg rest and a curved body bracket 34 suitably composed of stainless steel or aluminum for supporting the torso of the user are respectively adjustably attached to the main frame 14 at its middle and upper portions. In the embodiments illustrated in FIG. 1, the main wheel 18 is manually driven by a drive means suitably located upon the elongated leg member so as to permit the user's arm on the side of his injury to provide the required driving force. In the embodiment illustrated in FIG. 1, the drive means suitable comprises a drive wheel 36 attached at the upper portion of the elongated leg, having a handle 37 for rotating the drive wheel 36 and a drive belt 38 functionally connecting the drive wheel 36 to the main wheel 18 so that when the user turns the drive wheel 36 with the handle 37, the user and the mechanized crutch will move along the walking surface.

Figure 2:
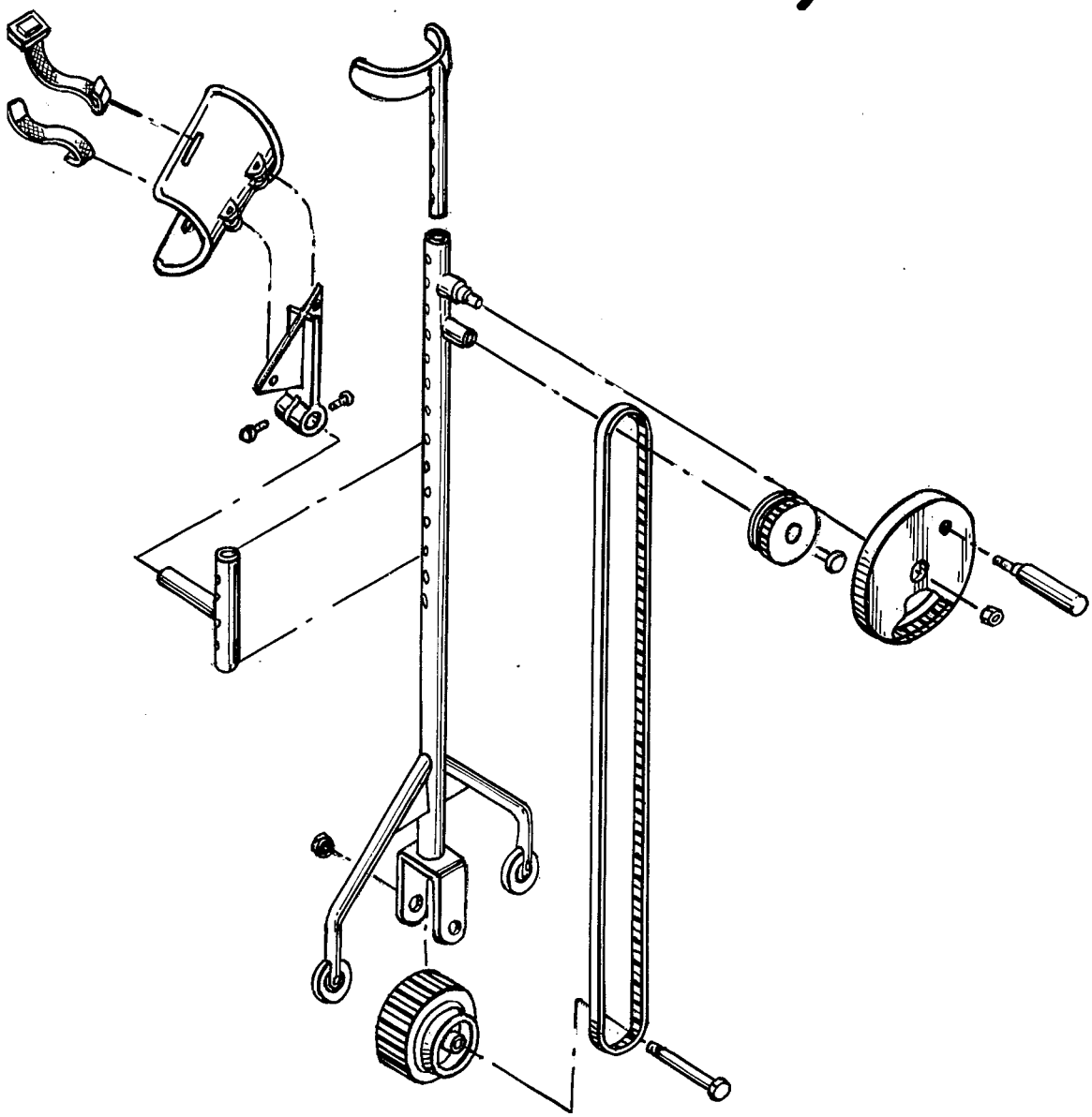
FIG. 2 is a exploded perspective view of the manually driven mechanized crutch shown in FIG. 1 in accordance with the present invention.

The individual elements of the drive system, leg rest, and body bracket of the preferred manual embodiment of the mechanized crutch are best described with reference to the exploded view illustrated in FIG. 2. The drive wheel 36, having a flat outer surface 39 and an outer rim 40, the inside of which consists of inside gearing 42, is rotatably mounted onto drive wheel support 44 on the main frame 14 through the flat outer surface hole 46 by a suitable means such as a hex nut. Manual drive may be provided through the handle 37 affixed to the outer surface 39 of the drive wheel 36. Just below the drive wheel support 44 on the main frame 14 is positioned a suitable support 50 for rotatably mounting an upper sheave-transfer gear assembly 52 having a diameter which is somewhat less than the radius of the drive wheel 36. The upper sheave-transfer gear assembly 52 has teeth 54 matched to the inside gearing 42. The supports 44 and 50 are positioned, and the upper sheave-transfer gear assembly 52 and the drive wheel 36 are sized, so that the transfer gear teeth 54 will rotate about its axis on support 50 when the drive wheel 36 is turned. The belt drive 38, which is suitably constructed of reinforced rubber of a chain or cleated style is mounted on the upper sheave 56 and a lower sheave 58 attached to the outer rim of main wheel 18 and thereby causes the latter to rotate when the drive wheel 36 is turned. The main wheel 18 which suitably has a wide tread ribbed polyurethane tire 60, is suitably attached to the main frame by a nut and bolt combination 62, 64 through holes in the side members of the C-shaped bracket 16, the bolt serving as the wheel's axle. The main frame is stabilized by front and rear outriggers 20 and 22 suitably composed of steel tubing and having small wheels 24 and 26, respectively, attached to the ends thereof.

The leg rest 30 is suitably composed of stainless steel or molded plastic and is generally molded in the shape of the back half circumference of an average user's lower thigh. Quick release straps 32 may be drawn through slits in the leg rest 30 in order to secure the injured leg in place. The double lugs 74 and 76 are molded on the central bottom surface of the leg rest 30 adapted for pin connection to a suitably cast or fabricated bracket 80 having the shape of intersecting triangular and rectangular flat sections crossing perpendicularly whereby the leg rest pin connections are connected to the bracket adjacent to the hypotenuse of the triangular section. A hollowed cylindrical portion 82, parallel to the rectangular portion and perpendicular to the surface of the triangular portion, is adapted to slide onto an adjustable leg rest bracket support 84. The adjustable leg bracket support 84 consists of a short tube 86 with vertically spaced holes adapted to slide up and down over the main frame 14 and centrally located perpendicular short shaft 88 on which the bracket cylindrical portion 82 is mounted with set screws at a suitable distance from the main frame 14. The leg rest may be vertically adjusted on the main frame 14 by placing a bolt and nut through selected holes in the leg rest support tubing section 86 and the main frame tubing 14.

The adjustable body bracket 34 suitably includes a main frame tubing 92 having a lesser diameter than that of the main frame tubing and having vertically spaced holes which permit height adjustment similar to that of the adjustable leg rest. Connected to the upper portion of the body bracket tube section 92 is a curved section 94 suitably composed of stainless steel or aluminum. The curve should be suitable for comfortably forming around the side torso of the user and may be padded for additional comfort.

The entire device may suitably be constructed of aluminum, stainless or steel tubing with a combination of fabricated, cast or molded parts to obtain light weight, strength and comfort. Other materials may, of course, also be utilized provided that they will serve the functions described above.

The above described unit provides a convenient means for locomotion for injured persons superior to the conventional wood or metal crutches which require the exertion of considerable muscle power to simultaneously support the body and provide forward motion by hopping on an uninjured leg. Although a particular preferred embodiment of the invention has been disclosed in detail above, for illustrative purposes, it will be understood that variations or modifications of the disclosure, which lie within the scope of the appended claims are fully contemplated. For example, while a manual means for driving the unit, i.e. handle 37, is illustrated, a battery power pack providing power to the main drive may be hung directly under the drive wheel 36 and controlled through the handgripped handle with start-stop and variable speed controls or through control actuated through the leg rest 30 by a slight walking motion of the injured leg.

What is claimed is:

1. A mechanized crutch for providing locomotion on a support surface to a person having an injured leg, comprising:

a vertically extending elongated leg member having a top and a lower portion;

body support means, connected to said elongated leg member for engaging the side of the person's body which includes the injured leg to support the side of the body of the person in a standing position while the person's other leg is engaging the surface, whereby said elongated leg member completely supports the person and said body support means when the person lifts his other leg from said surface, said body support means including means for engaging the injured leg and supporting the injured leg off of the surface;

a first lower wheel connected to said lower portion of said elongated leg member for rotation to locomote said person and said mechanized crutch when the person moves the other leg in a walking motion; and means, connected to said elongated leg member, for driving said first lower wheel.

2. A mechanized crutch as in claim 1 wherein said drive means comprises:

a manual drive wheel rotatably connected to the upper half of said elongated leg member; and a belt drive means, operatively connecting said drive wheel to said first lower wheel, for transmitting rotary power manually applied to said drive wheel to said first lower wheel.

3. A mechanized crutch as in claim 2 wherein:

said drive wheel comprises inside geating; and said belt drive means comprises an upper sheave-transfer gear assembly, including an upper sheave, operatively engaging said inside gearing, a lower sheave mounted on one side wall of said first lower wheel, and a drive belt operatively mounted on said upper and lower sheaves.

4. A mechanized crutch as in claim 1 wherein said body support means are vertically adjustable.

5. A mechanized crutch as in claim 1 or claim 2 or claim 3 or claim 4 wherein said body support means comprises a torso support means, disposed near said top of said elongated leg, for engaging and supporting the torso of the person; said injured leg supporting means being mounted to said elongated of the hips of the person when the person is standing upright.

6. A mechanized crutch as in claim 2 or claim 3 further comprising a handle affixed to said drive wheel for driving said first lower wheel by manually turning said drive wheel with a hand of the person, said drive wheel being mounted to said elongated leg member at a height approximately equal to the height of the hips of the person whel the person is standing upright.

7. A mechanized crutch as in claim 1 or claim 2 or claim 3 further comprising balance wheel means, rotatably mounted at the lower portion of said elongated leg member adjacent said first lower wheel, for providing support of the injured leg on the surface, said balance wheel means and first lower wheel fully supporting said elongated leg member and the person when the person lifts the other leg off of the surface.

8. A mechanized crutch as in claim 5 wherein said torso support means includes a torso support member curved in a horizontal plane substantially perpendicular to said elongated leg member to engage the rib cage of the person vertically beneath his arm pits.

9. A mechanized crutch as in claim 5 wherein said leg support means comprises means for engaging the back of the thigh of the injured leg.

10. A mechanized crutch as in claim 9 wherein said means for engaging the back of the thigh is mounted to said elongated leg, said crutch further comprising means for rotating said means for engaging the back of the thigh, such that the angle of support of said injured leg by said leg support means may be adjusted.

11. A mechanized crutch as in claim 9 wherein said means for engaging the back of the thigh comprises a curved leg support member having an upper surface substantially contoured in the shape of the back of a human lower thigh.

12. A mechanized crutch as in claim 10, further comprising a quick release strap for releasable holding said injured leg against said leg support member upper surface.

13. A mechanized crutch as in claim 2 wherein said elongated leg member comprises a vertically extending tube member having a vertical axis, said first lower wheel and said drive wheel having axes of rotation extending through said vertical axis.

14. A mechanized crutch for providing locomotion on a surface to a person having an injured leg, comprising:

(1) a support wheel for providing support during locomotion of said crutch and the person;

(2) an elongated leg, including a vertically extending main frame tube having a lower end, a top and a central portion and means for mounting said support wheel to said lower end;

(3) front and rear outrigger stabilizers having small wheels, fixed to said lower end;

(4) a leg brace having an upper surface molded in the general shape of the back of the lower thigh of the injured leg of the person for supporting the injured leg;

(5) means for mounting said leg brace to said central portion, said leg brace being rotatable about a horizontal axis to adjust the angle of support of said injured leg;

(6) a curved body bracket curved in a horizontal plane for engaging the rib cage of the person to support the torso of the person, said body bracket being vertically adjustably mounted to said top end; and (7) means, connected to said main frame tube for driving said support wheel, said driving means including a drive wheel rotatably connected to said middle portion such that it may be manually rotated by the person when standing upright with the injured leg supported by said leg brace and said torso supported by said curved body bracket, and (8) belt drive means, coupling said drive wheel to said support wheel, for transmitting rotary power manually applied to said wheel to said support wheel to locomote said person and said mechanized crutch.

* * * * *